US009200206B2

(12) United States Patent
Brownie et al.

(10) Patent No.: US 9,200,206 B2
(45) Date of Patent: Dec. 1, 2015

(54) ASPHALT PRODUCTION FROM OIL SAND BITUMEN

(75) Inventors: John H. Brownie, Brights Grove (CA); Mary Josephine Gale, Lambton Shore (CA); Lyle Edwin Moran, Sarnia (CA)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 57 days.

(21) Appl. No.: 13/571,931

(22) Filed: Aug. 10, 2012

(65) Prior Publication Data

US 2014/0042055 A1 Feb. 13, 2014

(51) Int. Cl.

| | |
|---|---|
| ***C10C 3/08*** | (2006.01) |
| ***C10G 1/04*** | (2006.01) |
| ***C10G 21/16*** | (2006.01) |
| ***C10G 21/18*** | (2006.01) |
| ***C10G 21/20*** | (2006.01) |
| ***C10G 21/00*** | (2006.01) |

(52) U.S. Cl.

CPC ..... *C10G 1/045* (2013.01); *C10G 21/003* (2013.01); *C10G 21/16* (2013.01); *C10G 21/18* (2013.01); *C10G 21/20* (2013.01); *C10G 2300/44* (2013.01); *C10G 2400/16* (2013.01)

(58) Field of Classification Search

CPC ..... C10G 1/006; C10G 1/04; C10G 1/047; C10C 3/08

USPC ..... 208/39–45, 390–391

See application file for complete search history.

(56) References Cited

U.S. PATENT DOCUMENTS

| | | | | |
|---|---|---|---|---|
| 3,884,829 | A * | 5/1975 | Moyer | 516/181 |
| 4,110,194 | A * | 8/1978 | Peterson et al. | 208/390 |
| 4,342,639 | A * | 8/1982 | Gagon | 208/390 |
| 4,929,341 | A * | 5/1990 | Thirumalachar et al. | 208/390 |
| 6,019,888 | A * | 2/2000 | Mishra et al. | 208/341 |
| 8,114,274 | B2 | 2/2012 | Moran et al. | |
| 2002/0170846 | A1 * | 11/2002 | Davis et al. | 208/39 |
| 2006/0196812 | A1 * | 9/2006 | Beetge et al. | 208/435 |
| 2008/0011643 | A1 * | 1/2008 | Lenglet et al. | 208/58 |
| 2009/0200209 | A1 | 8/2009 | Sury et al. | |
| 2009/0301931 | A1 * | 12/2009 | Koseoglu et al. | 208/22 |
| 2011/0210044 | A1 | 9/2011 | Chakrabarty et al. | |
| 2012/0000831 | A1 | 1/2012 | Moran et al. | |

FOREIGN PATENT DOCUMENTS

| | | | |
|---|---|---|---|
| CA | 2182453 | | 7/1996 |
| CA | 2682109 | A1 * | 1/2010 |
| WO | 8204440 | A1 | 12/1982 |

OTHER PUBLICATIONS

1-Pentanol, MSDS Rev. 5.3, Sigma-Aldrich, Jul. 24, 2013.*

(Continued)

*Primary Examiner* — Prem C Singh
*Assistant Examiner* — Brandi M Doyle
(74) *Attorney, Agent, or Firm* — Larry E. Carter; Robert A. Migliorini

(57) ABSTRACT

Methods are provided for making asphalt from crude oils derived from mined oil sands that have been subjected to a solvent froth treatment as part of the process for making a crude oil that is suitable for pipeline transport. A froth treatment is used that preserves a greater percentage of the asphaltene content of the crude oil derived from the mined oil sands.

20 Claims, 2 Drawing Sheets

(56) References Cited

OTHER PUBLICATIONS

Dipole Moment, Rosamonte's Physical Chemistry Website, Wordpress.com, last visited Jul. 24, 2013, http://physicalchemistryrosamonte.wordpress.com/material-balances/material-balances-on-a-crystallizer/physical-properties-of-pure-methanol/dipole-moment/.*

Baker Hughes White Paper, "Planning Ahead for Effective Canadian Crude Processing", 2010, www.bakerhughes.com.

L.L. Schramm, C. Morrison and E.N. Stasiuk, Some effect of chemical additions to nascent primary froth from the hot water flotation of bitumen from Athabasca oil sand, Fuel Processing Technology, vol. 56, No. 3, 1998, pp. 243-261.

* cited by examiner

ASPHALT PRODUCTION FROM OIL SAND BITUMEN

FIELD

This disclosure provides methods for producing asphalt from oil sand bitumens.

BACKGROUND

Asphalt is one of the world's oldest engineering materials, having been used since the beginning of civilization. Asphalt is a strong, versatile and chemical-resistant binding material that adapts itself to a variety of uses. For example, asphalt is used to bind crushed stone and gravel into firm tough surfaces for roads, streets, and airport runways. Asphalt, also known as pitch, can be obtained from either natural deposits, or as a by-product of the petroleum industry. Natural asphalts were extensively used until the early 1900s. The discovery of refining asphalt from crude petroleum and the increasing popularity of the automobile served to greatly expand the asphalt industry. Modern petroleum asphalt has the same durable qualities as naturally occurring asphalt, with the added advantage of being refined to a uniform condition substantially free of organic and mineral impurities.

Most of the petroleum asphalt produced today is used for road surfacing. Asphalt is also used for expansion joints and patches on concrete roads, as well as for airport runways, tennis courts, playgrounds, and floors in buildings. Another major use of asphalt is in asphalt shingles and roll-roofing which is typically comprised of felt saturated with asphalt. The asphalt helps to preserve and waterproof the roofing material. Other applications for asphalt include waterproofing tunnels, bridges, dams and reservoirs, rust-proofing and sound-proofing metal pipes and automotive under-bodies; and sound-proofing walls and ceilings.

The raw material used in modern asphalt manufacturing is petroleum, which is naturally occurring liquid bitumen. Asphalt is a natural constituent of petroleum, and there are crude oils that are almost entirely asphalt. The crude petroleum is separated into its various fractions through a distillation process. After separation, these fractions are further refined into other products such as asphalt, paraffin, gasoline, naphtha, lubricating oil, kerosene and diesel oil. Since asphalt is the base or heavy constituent of crude petroleum, it does not evaporate or boil off during the distillation process. Asphalt is essentially the heavy residue of the oil refining process.

U.S. Pat. No. 8,114,274 describes a method for treating bitumen froth with high bitumen recovery and dual quality bitumen production. The method includes using multiple gravity settling steps to separate phases containing bitumen in a hydrocarbon diluent from phases containing water, fine solids, and residual bitumen. Naphtha is provided as an example of a hydrocarbon diluent. One described advantage of the method is generation of a lighter bitumen stream that is suitable for transport by pipeline without further processing.

U.S. Published Patent Application 2012/0000831 describes methods for separating out a solvent feed after use in recovery of bitumen from oil sands. The method includes treating a bitumen froth with a paraffinic or naphthenic type diluent to produce bitumen and froth treatment tailings. Toluene is identified as a naphthenic type diluent that can improve bitumen recovery from tailings.

SUMMARY

In an embodiment, a method is provided for producing asphalt. The method includes forming a froth from a mixture of a raw crude derived from mined oil sands and water, the froth corresponding to an oil-based phase; adding a polar organic solvent to the froth, the polar organic solvent having a dipole moment of $2.0\times10^{-30}$ Cm to $5.9\times10^{-30}$ Cm at 20° C., a solubility in water of less than 25 g/L, a boiling point of at least 70° C., and a melting point of 20° C. or less; separating the oil-based phase from the water; and preparing at least a portion of the oil-based phase for transport via pipeline.

DETAILED DESCRIPTION

Figure 1:
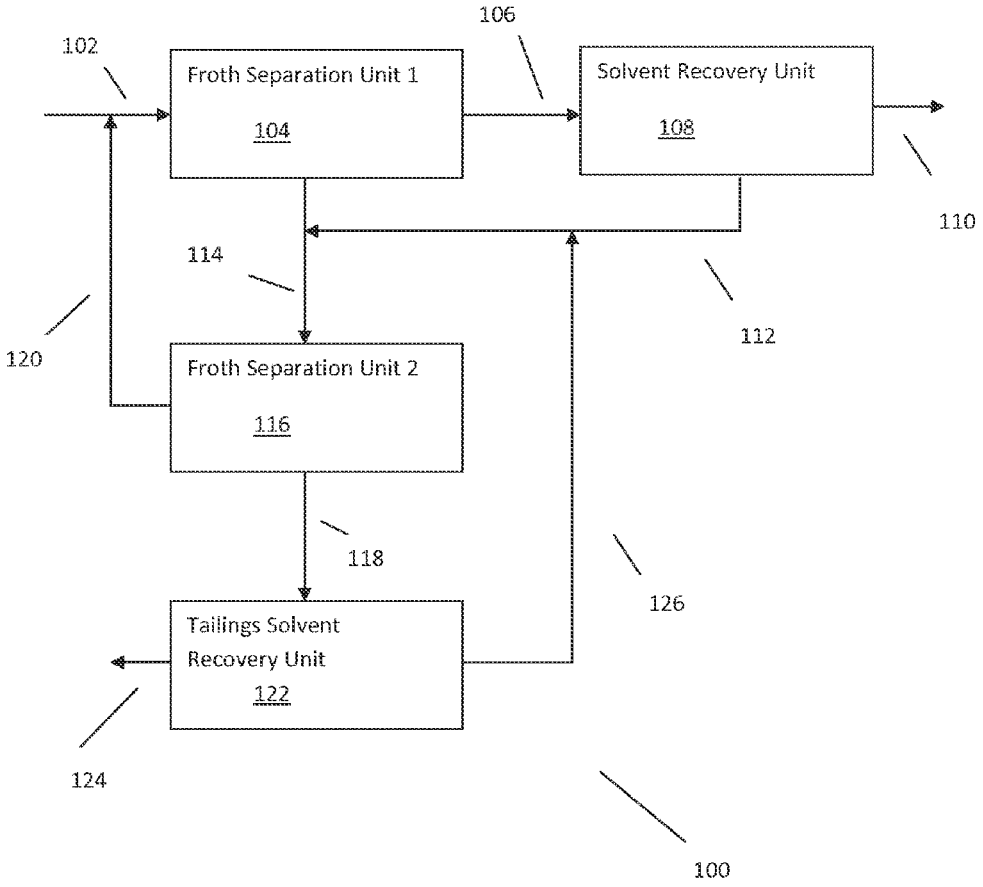
FIG. 1 schematically shows an example of a froth treatment process.

All numerical values within the detailed description and the claims herein are modified by "about" or "approximately" the indicated value, and take into account experimental error and variations that would be expected by a person having ordinary skill in the art.

Overview

In various aspects, methods are provided for making asphalt from crude oils derived from mined oil sands that have been subjected to a solvent froth treatment as part of the process for making a crude oil that is suitable for pipeline transport. Providing an improved method for asphalt production from bitumens derived from mined oil sands addresses a long-felt need in the art for improving the overall usage of crude oils derived from mined oil sands.

Generating Crude Oil from Oil Sands

As with many crude oils, a goal for crude oils produced from oil sands is to generate useful products at a reasonable cost. With respect to oil sands, one of the cost considerations is how to remove the oil sands from the ground and transport them to a refinery. Some upgrading or processing of a crude oil formed from oil sands can be performed at the oil sands production site, but avoiding the costs of such an on-site upgrader facility is desirable.

In general, crude oils are currently derived from two types of oil sands. Some oil sands are sufficiently close to the surface that the oil sands can be accessed by raining. Such mined oil sands are the focus of this disclosure. For some other types of oil sands, the location of the oil sands does not lend itself to mining. Instead, steam assisted methods can be used to generate crude oil from such oil sands. Steam assisted methods have the advantage of capturing a high percentage of the raw crude. The crude oil generated by steam assisted methods is also often suitable for pipelining and/or formation of asphalts. Unfortunately, steam assisted methods of oil sands extraction are energy intensive, and therefore more expensive than extraction of oil sands via mining.

Although mining of oil sands avoids some of the difficulties with steam extraction methods, mining of oil sands can present other challenges. In particular, mined oil sands often require some further processing at the mine site to allow for transport of the resulting crude oil. One option for in-situ processing of mined oil sands is to form a synthetic or pre-refined crude oil. For example, a simple fractionation can be performed at the production site to generate a bottoms portion of crude oil derived from oil sands. This bottoms portion of crude oil derived from oil sands can then be processed at the production site using a coker and/or other processing technologies to produce lower viscosity streams that also have lower sulfur concentrations. This results in conversion of heavy molecules to lighter molecules, leading to generation of lower viscosity fractions such as diesel, kerosene, and/or naphtha boiling range fractions that together form a synthetic crude oil along with the lighter ends previously separated from the bitumen.

Forming a synthetic crude oil from a challenging source, such as oil sands, has several advantages. The synthetic crude oil is typically a light sweet crude oil, in contrast to the heavy sour crude oil that is initially derived from oil sands. The diluent also improves the characteristics of the synthetic crude for transport via pipeline from the production site to a refinery. However, forming a synthetic crude requires building a process train at the oil sands production site that includes one or more upgrading processes. Additionally, due to the processing of the bottoms portion of the crude during formation of the synthetic crude oil, the synthetic crude oil is not useful for making asphalt. During synthetic crude formation, substantially all of the molecules originally present in the crude oil that correspond to vacuum resid boiling range molecules (such as 950° F.+ or 510° C.+ molecules) are converted to lower boiling molecules. Thus, the molecules typically used for making asphalt are not present in a synthetic crude. Also, because a coker is typically used to convert the bottoms portion to diluent, the coker also generates a substantial amount of coke. The generation of coke means that a portion of the carbon in the crude oil is used to form a low value product. When possible, it is desirable to avoid the formation of such low value products, Still another alternative for forming a crude oil from mined oil sands that avoids steam treatment and/or construction of an in-situ upgrading facility is to use a froth treatment. During mining of oil sands, a portion of non-petroleum solid material, such as sand, typically remains in the mined oil sands after removal from the earth. A froth treatment can be used to further separate the desired raw crude oil from the non-petroleum particulate matter. For example, raw crude based on mined oil sands can be mixed with water. Typically, the raw crude from mined oil sands and water is also aerated. The aerated mixture of raw crude based on mined oil sands and water is then allowed to settle so that solid particles (such as sand) can be knocked out of the raw crude. After settling, the mixture will typically include an oil "froth" phase containing crude oil (sometimes referred to as bitumen) and some smaller solid particles on top of an aqueous phase.

Removal of solids from the froth phase can be enhanced by adding a solvent to the bitumen. One example of a suitable solvent is a paraffinic type solvent, such as pentane, isopentane, or another alkane (or mixture of alkanes) containing 5 to 8 carbon atoms. Additional of the solvent to the froth results in additional release of small particles into the water phase. However, a substantial portion of the asphaltenes present in the froth (such as 40%-55%) also typically enter the water phase due to addition of the paraffinic type solvent. The froth is then separated from the water phase, followed by distillation to remove the solvent and leave behind a froth treated crude oil. The froth treated crude oil is typically mixed with a lower viscosity material, such as naphtha or kerosene, to produce an overall mixture that is suitable for pipeline transport. The crude oil resulting from such a froth treatment process is typically not suitable for making commercially desirable grades of asphalt.

More generally, froth treated crude oils are viewed as not being suitable for making asphalts. A 2010 white paper published by Baker Hughes was related to future directions for processing of crude oils derived from mined oil sands. The white paper included a description of product slates from processing of oil sands, and noted the poor quality, uncertain quality, or lack of availability of asphalt depending on the processing technique selected. (See Baker Hughes white paper titled "Planning Ahead for Effective Canadian Crude Processing," 2010.)

Based on the above, neither forming synthetic crude or performing a paraffinic froth treatment, the two common methods for processing mined oil sands formations to generate a crude oil suitable for transport via pipeline, are believed to result in a crude oil suitable for asphalt production. As a result, methods are needed for forming a crude oil derived from oil sands that is both suitable for pipeline transport and suitable for use in making asphalt.

In order to overcome the above difficulties, a crude oil derived from oil sands can be formed using a froth treatment that reduces the amount of asphaltenes lost during the froth treatment. The reduction in asphaltene loss can be achieved by selecting appropriate conditions for a paraffinic froth treatment, and/or by selecting an alternative solvent for the froth treatment that reduces or minimizes asphaltene loss. By retaining additional asphaltenes while still forming a crude oil suitable for pipeline transport, the resulting crude oil can be used at a refinery for asphalt production. This allows a crude oil formed from mined oil sands to be used for asphalt production, in spite of the conventional industry view that mined oil sands are not suitable for use in asphalt.

Asphalt Feedstocks and Asphalt Formation

An increasing proportion of crude oil production corresponds to heavier crude oils as well as non-traditional crudes, such as crude oils derived from oil sands. Initial extraction of heavier crude oils and non-traditional crudes can present some additional challenges. For example, during mining or extraction of oil sands, a large percentage of non-petroleum material (such as sand) is typically included in the raw product. This non-petroleum material is typically separated from the crude oil at the extraction site. At an oil sands production site where the sands are mined to recover the raw crude, over 50% of the mined material can correspond to non-petroleum particulate matter.

One option for removing the non-petroleum material is to first mix the raw product with water. For example, a water extraction process can be used to separate a majority of the non-petroleum material from the desired raw crude or bitumen. A hot water or cold water extraction process is an example of a process for mixing water with oil sands to extract the raw crude. Air is typically bubbled through the water to assist in separating the bitumen from the non-petroleum material. A water extraction process can remove a large proportion of the solid, non-petroleum material in the raw product. However, after the initial water extraction process, smaller particles of non-petroleum particulate solids will typically remain with the oil phase at the top of the mixture. This top oil phase is sometimes referred to as a froth.

Separation of the smaller non-petroleum particulate solids can be achieved by adding an extraction solvent to the froth of the aqueous mixture. This is referred to as a "froth treatment". Examples of typical paraffinic solvents include isopentane, pentane, and other light paraffins (such as $C_5$-$C_8$ paraffins) that are liquids at room temperature. Other extraction solvents can include polar organic extraction solvents, such as trichloroethylene. Still other extraction solvents can include naphthenic solvents, such as toluene or naphtha. Adding the extraction solvent results in a two phase mixture, with the crude and the extraction solvent forming one of the phases. The smaller particulate solids of non-petroleum material are "rejected" from the oil phase and join the aqueous phase. The crude oil and solvent phase can then be separated from the aqueous phase, followed by recovery of the extraction solvent for recycling. This results in a heavy crude oil that is ready either for further processing or for blending with a lighter fraction prior to transport via pipeline. For convenience, a heavy crude oil formed by using a froth treatment to separate out particulate non-petroleum material will be referred to herein as a froth-treated crude oil.

While the above technique is beneficial for removing smaller non-petroleum particulate solids from a crude oil, the froth treatment also results in depletion of asphaltenes in the resulting froth-treated crude oil. Asphaltenes typically refer to compounds within a crude fraction that are insoluble in a paraffin solvent such as n-heptane. When an extraction solvent is conventionally added to the mixture of raw product and water, between 30 and 60 percent of the asphaltenes in the crude oil are typically "rejected" and lost to the water phase along with the smaller non-petroleum particulate solids. As a result, the froth-treated crude oil that is separated out from the non-petroleum material corresponds to an asphaltene-depleted crude oil.

To facilitate the production of asphalt from a froth-treated crude oil, the loss of asphaltenes can be reduced or minimized. Methods for reducing or minimizing the loss of asphaltenes from a froth-treated crude oil are described in more detail below.

After forming a froth-treated crude oil, the froth-treated crude will typically be transported to a refinery for further processing. For example, after recovery of the extraction solvent used for treating the froth during formation of a froth-treated crude oil, the resulting froth-treated crude oil will typically have a high viscosity that is not suitable for transport in a pipeline. In order to transport the froth-treated crude oil, the froth-treated crude oil can be mixed with a lighter fraction that is compatible with pipeline and refinery processes, such as a naphtha or kerosene fraction. The froth-treated crude can then be transported to a refinery. Other methods may be used to prepare other types of asphaltene-depleted crudes for pipeline transport (or other transport).

At a refinery, a froth-treated crude oil could be used directly as a crude oil. Alternatively, the froth-treated crude oil can be blended with one or more crude oils or crude fractions. Crude oils suitable for blending prior to distillation can include whole crudes, reduced crudes, synthetic crudes, or other convenient crude fractions that contain material suitable for incorporation into an asphalt. This blending can occur at the refinery or prior to reaching the refinery. To form asphalt, the froth-treated crude or the blend of crudes containing the froth-treated crude is distilled. Typically the crude (s) will be distilled by atmospheric distillation followed by vacuum distillation. The bottoms cut from the vacuum distillation represents the fraction for potential use as an asphalt feedstock.

Before or after distillation, other feedstocks can be blended with the vacuum distillation bottoms, such as heavy oils that include at least a portion of asphaltenes. Thus, in addition to other crudes or crude fractions, other suitable feedstocks for blending include straight run vacuum residue, mixtures of vacuum residue with diluents such as vacuum tower wash oil, paraffin distillate, aromatic and naphthenic oils and mixtures thereof, oxidized vacuum residues or oxidized mixtures of vacuum residues and diluent oils and the like.

Any convenient amount of a froth-treated crude fraction may be blended with other feedstocks for forming a feed mixture to produce an asphalt feedstock. One option is to characterize the amount of froth-treated crude fraction in a mixture of crude fractions prior to distillation to form an asphalt feed. The amount of froth-treated crude fraction in the mixture of crude fractions can be at least 10 wt % of the mixture, such as at least 25 wt % of the mixture, or at least 40 wt % of the mixture, or at least 50 wt % of the mixture. Additionally or alternately, the amount of froth-treated crude fraction in the mixture of crude fractions can be 90 wt % of the mixture or less, such as 75 wt % of the mixture or less, or 50 wt % of the mixture or less.

Alternatively, if an asphalt feed based on a froth-treated crude is blended with other asphalt feeds after distillation to form the asphalt feed, the amount of froth-treated crude in the asphalt fraction can be characterized. The amount of froth-treated crude in an asphalt fraction can be at least 25 wt % of the mixture, such as at least 40 wt % of the mixture and/or 75 wt % or less of the mixture, such as 60 wt % or less of the mixture.

After any blending with crude oils or other crude fractions, a feedstock can be distilled in order to separate out the fraction used for forming asphalt. For example, a feedstock can be distilled using an atmospheric distillation followed by a vacuum distillation of the bottoms fraction from the atmospheric distillation. The resulting bottoms fraction from the vacuum distillation can be used to form an asphalt.

One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil. Similarly, a "T95" boiling is defined as the temperature at which 95 wt % of the feed will boil.

A typical feedstock for forming asphalt can have a normal atmospheric boiling point of at least 350° C., more typically at least 400° C., and will have a penetration range from 20 to 500 dram at 25° C. (ASTM D-5). Alternatively, a feed may be characterized using a T5 boiling point, such as a feed with a T5 boiling point of at least 350° C., or at least 400° C., or at least 440° C.

Retaining Asphaltenes in Froth-Treated Crude Oil

The amount of asphaltenes retained in a froth-treated crude oil can be increased in a variety of ways. One option is to select a solvent for the froth treatment that is compatible with an increased amount of asphaltenes. An example of a solvent that can reduce or minimize the number of asphaltenes that are lost during a froth treatment is a polar organic solvent, such as trichloroethylene (TCE). TCE has a dipole moment of $2.67\times10^{-3}$ Cm (0.8 debye) at 20° C. TCE also has a solubility in water of 1.2 g/L, so that TCE will readily form a separate phase when added to water in sufficient quantities. More generally, suitable polar organic solvents can include solvents with a dipole moment of $2.0\times10^{-3}$ Cm to $5.9\times10^{-30}$ Cm and a solubility in water of less than 25 g/L. Suitable polar organic solvents preferably have a boiling point sufficiently above room temperature to reduce or minimize losses to evaporation during a froth treatment, such as a boiling point of at least 70° C. Suitable polar organic solvents preferably also have a melting point of room temperature or less, so that the polar organic solvent forms a liquid phase at or near room temperature. Thus, a suitable melting point for a polar organic solvent is 30° C. or less, such as 25° C. or less or 20° C. or less. Based on the above, other examples of suitable polar organic solvents include aliphatic alcohols containing 5 to 8 carbons (such as 1-pentanol or 1-octanol), carboxylic acids containing 5 to 8 carbons (such as hexanoic acid), and amities such as triethyl amine.

Another type of solvent that can be used for increasing the amount of asphaltenes retained in a froth-treated crude oil is a non-polar and/or low polarity aromatic solvent, such as benzene or toluene. (For example, toluene has a dipole moment of $1.25\times10^{-3}$ Cm (0.375 debye). Other suitable aromatic solvents preferably have a boiling point sufficiently above room temperature to reduce or minimize losses to evaporation during a froth treatment, such as a boiling point of at least 70° C. Suitable aromatic solvents preferably also have a melting point of room temperature or less, so that the polar organic solvent forms a liquid phase at or near room temperature. Thus, a suitable melting point for an aromatic solvent is 30° C. or less, such as 25° C. or less or 20° C. or less. It is noted that mixtures of solvents can also be used. Thus, a typical naphtha can also be used, as a typical naphtha corresponds to a mixture of paraffin solvents and aromatic solvents. Additionally, although not aromatics, small cycloalkanes such as cyclohexane and/or cyclopentane may also be suitable solvents.

Still another option for improving retention of asphaltenes in a froth-treated crude oil is to adjust the treatment conditions for the froth treatment. This can include controlling the amount of solvent added to the froth and/or controlling the temperature of the froth treatment process.

Example of System for Performing a Froth Treatment

A typical system for performing a froth treatment to separate hydrocarbons out from oils sands may be a plant located at or near a bitumen (e.g. heavy hydrocarbon) mining or recovery site or zone. The plant may include at least one froth separation unit (FSU) having a bitumen froth inlet for receiving bitumen froth (or a solvent froth-treated bitumen mixture) and a diluted bitumen outlet for sending diluted bitumen from the FSU. Optionally, the plant can further include a water droplet production unit configured to add water droplets to the solvent froth-treated bitumen mixture, one or more of the FSU's, and/or the diluted bitumen from at least one of the FSU's. The plant may also include at least one tailings solvent recovery unit (TSRU), solvent storage unit, pumps, compressors, and other equipment for treating and handling the heavy hydrocarbons and byproducts of the recovery system.

FIG. 1 shows an example of a system for using a froth treatment process to recover hydrocarbons (such as a bitumen or heavy crude oil) from oil sands. Referring now to the figures. FIG. 1 is a schematic of a general froth treatment system. The plant 100 receives bitumen froth 102 from a heavy hydrocarbon recovery process, such as a Clark hot water extraction process. The bitumen froth 102 is fed into a first froth separation unit (FSU) 104 and solvent-rich oil 120 is mixed with the bitumen froth 102. A diluted bitumen stream 106 and a tailings stream 114 are produced from the FSU 104. The diluted bitumen stream 106 is sent to a solvent recovery unit (SRU) 108, which separates bitumen from solvent to produce a bitumen stream 110 that meets pipeline specifications. The SRU 108 also produces a solvent stream 112. In this example, solvent stream 112 is mixed with tailings 114 from the first FSU 104 and fed into a second froth separation unit 116. The second FSU 116 produces a solvent rich oil stream 120 and a tailings stream 118. The solvent rich oil stream 120 is mixed with the incoming bitumen froth 102 and the tailings stream is sent to a tailings solvent (TSRU) recovery unit 122, which produces a tailings stream 124 and a solvent stream 126. In this type of system, the solvent can correspond to one or more paraffinic solvents, one or more polar organic solvents, one or more aromatic solvents, or a mixture thereof.

A system such as the system shown in FIG. 1 can be used to form a crude oil derived from oil sands. For example, after separating a majority of the particulate matter from the desired bitumen using a heavy hydrocarbon recovery process, such as Clark hot water extraction, the resulting bitumen froth 102 may be mixed with a solvent-rich oil stream 120 from FSU 116 in FSU 104. The temperature of FSU 104 may be maintained at 60 to 80 degrees Celsius (° C.), or 70° C. and the target solvent to bitumen ratio is 1.4:1 to 2.2:1 by weight or 1.6:1 by weight. The overflow from FSU 104 is the diluted bitumen product 106 and the bottom stream 114 from FSU 104 is the tailings substantially comprising water, mineral solids, asphaltenes, and some residual bitumen. The residual bitumen from this bottom stream is further extracted in FSU 116 by contacting it with fresh solvent (from e.g. 112 or 126), for example in a 25:1 to 30:1 by, weight solvent, to bitumen ratio at, for instance, 80 to 100° C., or 90° C. The solvent-rich overflow 120 from FSU 116 is mixed with the bitumen froth feed 102. The bottom stream 118 from FSU 116 is the tailings substantially comprising solids, water, asphaltenes, and residual solvent. The bottom stream 118 is fed into a tailings solvent recovery unit (TSRU) 122, a series of TSRUs or by another recovery method. In the TSRU 122, residual solvent is recovered and recycled in stream 126 prior to the disposal of the tailings in the tailings ponds (not shown) via a tailings flow line 124. Exemplary operating pressures of FSU 104 and FSU 1116 are respectively 550 thousand Pascals gauge (kPag) and 600 kPag. FSUs 104 and 116 are typically made of carbon-steel but may be made of other materials.

An exemplary composition of a bitumen froth 102 is 60 wt % bitumen, 30 wt % water and 10 wt % solids, with some variations to account for the extraction processing conditions. In such an extraction process oil sands are mined, bitumen is extracted from the sands using water (e.g. the CHWE process or a cold water extraction process), and the bitumen is separated as a froth comprising bitumen, water, solids and air. Preferably, air is added to the bitumen/water/sand slurry to help separate bitumen from sand, clay and other mineral matter. The bitumen attaches to the air bubbles and rises to the top of the separator (not shown) to form a bitumen-rich froth 102 while the sand and other large particles settle to the bottom. Regardless of the type of water based oil sand extraction process employed, the extraction process will typically result in the production of a bitumen froth product stream 102 comprising bitumen, water and fine solids (including asphaltenes, mineral solids) and a tailings stream 114 consisting essentially of water and mineral solids and some fine solids.

In one example of a process for forming a froth-treated bitumen or crude oil, solvent 120 can be added to the bitumen-froth 102 after extraction and the mixture is pumped to another separation vessel (froth separation unit or FSU 104). The addition of solvent 120 helps remove the remaining fine solids and water. Put another way, solvent addition increases the settling rate of the fine solids and water out of the bitumen mixture. As another option, a solvent can be used to dilute the bitumen froth 102 before separating the product bitumen by gravity in a device such as FSU 104.

As would be expected with any process, the optimum conditions would be preferred to produce the largest particle size distribution and subsequently the fastest settling time. Variables may be optimized include, but are not limited to; water-to-bitumen ratio (e.g. from 0.01 wt %, mixing energy, water droplet size, temperature, solvent addition, and location of water addition. Water may be added either to the FSU feed streams 102, 114 and/or internally within the FSU vessels 104, 116. Within the FSU vessels the water can be added either above and/or below the feed injection point. Further, the type of water used will depend on the available water sources, but is preferably one of fresh river water, distilled water from a solvent recovery unit 108, recycled water, rain water, or aquifer water.

Example

Product Properties of Asphalt Derived from Froth-Treated Crude Oils

One way of characterizing an asphalt composition is by using SUPERPAVE™ criteria. SUPERPAVE™ criteria. (as described in the June 1996 edition of the AASHTO Provisional Standards Book and 2003 revised version) can be used to define the Maximum and Minimum Pavement service temperature conditions under which the binder must perform. SUPERPAVE™ is a trademark of the Strategic Highway Research Program (SHRP) and is the term used for new binder specifications as per AASHTO MP-1 standard. Maximum Pavement Temperature (or "application" or "service" temperature) is the temperature at which the asphalt binder will resist rutting (also called Rutting Temperature). Minimum Pavement Temperature is the temperature at which the binder will resist cracking. Low temperature properties of asphalt binders were measured by Betiding Beam Rheometer (BBR). According to SUPERPAVE™ criteria, the temperature at which a maximum creep stiffness (S) of 300 MPa at 60 s loading time is reached, is the Limiting Stiffness Temperature (LST). Minimum Pavement Temperature at which the binder will resist cracking (also called Cracking Temperature) is equal to LST-10° C.

The SUPERPAVE™ binder specifications for asphalt paving binder performance establishes the high temperature and low temperature stiffness properties of an asphalt. The nomenclature is PG XX-YY which stands for Performance Grade at high temperatures (HT), XX, and at low temperatures (LT), −YY° C., wherein −YY means a temperature of minus YY° C. Asphalt must resist high summer temperature deformation at temperatures of XX° C. and low winter temperature cracking at temperatures of −YY° C. An example popular grade in Canada is PG 58-28. Each grade of higher or lower temperature differs by 6° C. in both HT and LT. This was established because the stiffness of asphalt doubles every 6° C. One can plot the performance of asphalt on a SUPERPAVE™ matrix grid. The vertical axis represents increasing high PG temperature stiffness and the horizontal axis represents decreasing low temperature stillness towards the left. In some embodiments, a heavy oil fraction used for producing the deasphalted residue and/or the heavy oil fraction used for forming a mixture with the deasphalted residue can have a performance grade at high temperature of 58° C. or less, or 52° C. or less, or 46° C. or less.

Figure 2:
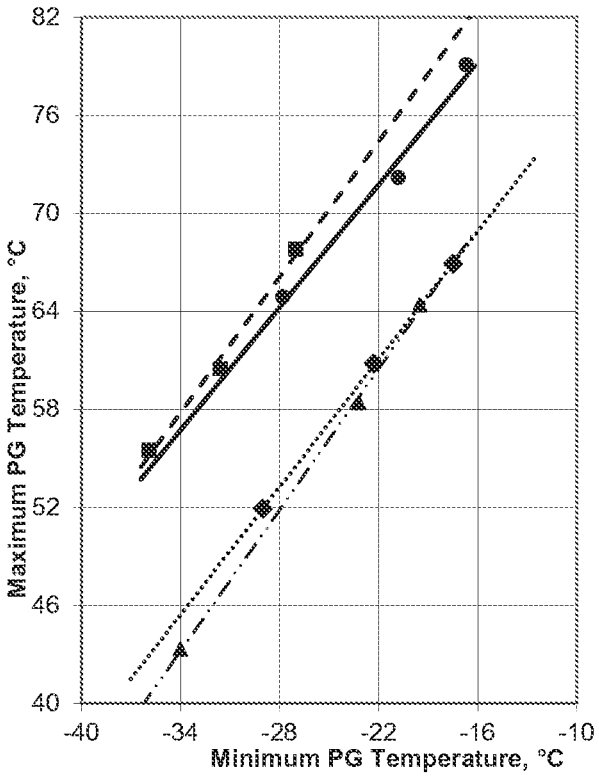
FIG. 2 shows examples of asphalts formed from various crude oil sources.

The data in FIG. 2 is plotted on a SUPERPAVE™ PG matrix grid. These curves pass through various PG specification boxes. Asphalt binders from a particular crude pass the SUPERPAVE™ specification criteria if they fall within the PG box through which the curves pass. Directionally poorer asphalt performance is to the lower right. Target exceptional asphalt or enhanced, modified asphalt performance is to the upper left, most preferably in both the HT and LT performance directions.

Although asphalt falls within a PG box that allows it to be considered as meeting a given PG grade, the asphalt may not be robust enough in terms of statistical quality control to guarantee the PG quality due to variation in the PG tests. This type of property variation is recognized by the asphalt industry as being as high at approximately +/−3° C. Thus, if an asphalt producer wants to consistently manufacture a given grade of asphalt, such PG 64-28, the asphalt producer must ensure that the PG tests well within the box and not in the right lower corner of the box. Any treatment which moves the curve out of the lower right corner even if only in the HT direction is deemed to result in the production of a higher quality asphalt, even if nominally in the same grade.

FIG. 2 shows a SUPERPAVE™ plot for asphalts formed from crude oils derived from various oil sands. In FIG. 2, the squares and the corresponding dotted line the potential asphalts that can be formed from an oil sands source that is removed from the source using steam removal techniques. As shown in FIG. 2, the crude oil derived from oil sands that is removed using steam removal techniques passes through the center of the 58-28 and 64-22 boxes, indicating that this crude oil is suitable for making desirable grades of asphalts.

FIG. 2 also shows four other sets of data. The diamond and triangle data sets (and corresponding lines) correspond to crude oils derived from two different oil sands sources using a conventional paraffinic froth treatment. As shown in FIG. 2, the conventional paraffinic froth treatment results in a crude oil that cannot make desirable grades of asphalt. The lines for potential asphalts that can be formed from the paraffinic froth-treated crude oils are a full box away from the desired 58-28 and 64-22 boxes on the SUPERPAVE™ grid. As a result, the asphalts formed from these paraffinic froth-treated crude oils would have low or minimal value in the marketplace.

For the circle data set, a mixture of bit-froth (oil sands processed through the first water extraction and settling) and trichloroethylene was formed by mixing bit-froth and trichloroethylene using the following procedure. The froth was sampled at ambient temperature to obtain a 1000 g sample. The sample was added to a Rotarex extractor along with 500 mL of filtered trichloroethylene and dried filter paper. ASTM D2172 Test Method A (Standard Test Methods for Quantitative Extraction of Bitumen From Bituminous Paving Mixtures) was modified to run the Bit Froth. ASTM D2172 is intended for road mixes that have an asphalt content of approximately 5%. The sampled froth had a bitumen content of approximately 60% bitumen. The sample was allowed to stand with occasional agitation for 15 min. The Rotarex extractor was started slowly and allowed to come to full speed of 1800 rpm. This speed was maintained until the solvent ceased to flow from the drain tube. Another 500 mL of trichloroethylene was added, and allowed to sit for another 15 min with occasional agitation. Again the Rotarex was used to spin off the bitumen/solvent mixture. Another wash with 200 mL trichioroethylene was allowed to sit for 10 min, then 5 min, and another 5 min until the bitumen/trichloroethylene mixture was a straw color. The bitumen/trichloroethylene mixture was collected in a metal container. Four extractions were performed and all of the bitumen/solvent was collected together. The bitumen/solvent mixture was then distilled to produce a reduced crude (343° C.+) using a 9 liter Hivac still (ASTM D5236). The reduced crude was then distilled to 460° C.+ while collecting overheads from 420° C. to 440° C. and from 440° C. to 460° C. so that residue samples could be back blended to form 440° C.+ and 420° C.+ reduced crudes. These reduced crudes were then tested to determine the asphalt properties shown on the SUPERPAVE™ grid. As shown by the circle data set (and corresponding solid curve fit line) in FIG. 2, the froth-treated crudes derived from oil sands by a froth-treatment corresponding to the disclosure resulted in asphalts that correspond to the desired 58-28 or 64-22 boxes on the SUPERPAVE™ grid.

PCT and EP Clauses

Embodiment 1

A method for producing asphalt, comprising: forming a froth from a mixture of a raw crude derived from mined oil sands and water, the froth corresponding to an oil-based phase; adding a polar organic solvent to the froth, the polar organic solvent having a dipole moment of $2.0\times10^{-30}$ Cm to $5.9\times10^{-30}$ Cm at 20° C., a solubility in water of less than 25 g/L, a boiling point of at least 70° C., and a melting point of 20° C. or less; separating the oil-based phase from the water; and preparing at least a portion of the oil-based phase for transport via pipeline.

Embodiment 2

The method of Embodiment 1, wherein forming a froth from a mixture of raw crude and water comprises performing a hot water extraction process or a cold water extraction process on the raw crude.

Embodiment 3

The method of any of the above embodiments, wherein preparing at least a portion of the oil-based phase for transport via pipeline comprises separating the solvent from the oil-based phase.

Embodiment 4

The method of Embodiment 3, wherein preparing at least a portion of the oil-based phase for transport further comprises mixing the at least a portion of the oil-based phase with a naphtha boiling range or kerosene boiling range diluent.

Embodiment 5

The method of any of the above embodiments, wherein the polar organic solvent is an alcohol, a carboxylic acid, or an amine Embodiment 6

The method of any of the above embodiments, wherein the polar organic solvent contains 8 carbons or less.

Embodiment 7

The method of any of the above embodiments, wherein the polar organic solvent, has a melting point of 30° C. or less.

Embodiment 8

The method of any of the above embodiments, wherein the polar organic solvent comprises trichloroethylene.

Embodiment 9

The method of any of the above embodiments, further comprising distilling the at least a portion of the oil based phase to form an asphalt feed; and forming an asphalt from the asphalt feed.

Embodiment 10

The method of Embodiment 9, wherein distilling the at least a portion of the oil-based phase comprises performing a vacuum distillation on the at least a portion of the oil-based phase, the asphalt feed corresponding to a bottoms fraction produced by the vacuum distillation.

Embodiment 11

The method of Embodiment 9 or 10, wherein the at least a portion of the oil-based phase is mixed with one or more other feeds prior to distillation.

Embodiment 12

The method of any of the above embodiments, wherein the polar organic solvent is added to the froth under effective conditions so that an asphaltene content of the froth is at least 80% of an asphaltene content of the raw crude, When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains. All documents described herein are incorporated by reference herein, including any priority documents and/or testing procedures to the extent they are not inconsistent with this text.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for producing asphalt, comprising:

forming a froth from a mixture of a raw crude derived from mined oil sands and water, the froth corresponding to an oil-based phase on top of an aqueous phase;

adding a solvent consisting essentially of a polar organic solvent to the froth, the polar organic solvent having a dipole moment of $2.0\times10^{-30}$ Cm to $5.9\times10^{-30}$ Cm at 20° C., a solubility in water of less than 25 g/L, a boiling point of at least 70° C., and a melting point of 20° C. or less, a weight ratio of solvent to bitumen after addition of the polar organic solvent being 1.4:1 to 2.2:1;

separating, after addition of the solvent consisting essentially of the polar organic solvent, the oil-based phase from the water; and preparing at least a portion of the oil-based phase for transport via pipeline.

2. The method of claim 1, wherein forming a froth from a mixture of raw crude and water comprises performing a hot water extraction process or a cold water extraction process on the raw crude.

3. The method of claim 1, wherein preparing at least a portion of the oil-based phase for transport via pipeline comprises separating the solvent from the oil-based phase.

4. The method of claim 3, wherein preparing at least a portion of the oil-based phase for transport further comprises mixing the at least a portion of the oil-based phase with a naphtha boiling range or kerosene boiling range diluent.

5. The method of claim 1, wherein the polar organic solvent is an alcohol, a carboxylic acid, or an amine.

6. The method of claim 1, wherein the polar organic solvent contains 8 carbons or less.

7. The method of claim 1, wherein the polar organic solvent has a melting point of 30° C. or less.

8. The method of claim 1, wherein the polar organic solvent comprises trichloroethylene.

9. The method of claim 1, further comprising distilling the at least a portion of the oil based phase to form an asphalt feed; and forming an asphalt from the asphalt feed.

10. The method of claim 9, wherein distilling the at least a portion of the oil-based phase comprises performing a vacuum distillation on the at least a portion of the oil-based phase, the asphalt feed corresponding to a bottoms fraction produced by the vacuum distillation.

11. The method of claim 9, wherein the at least a portion of the oil-based phase is mixed with one or more other feeds prior to distillation.

12. The method of claim 1, further comprising adding a solvent consisting essentially of the polar organic solvent to the water separated from the oil phase, a weight ratio of solvent to bitumen in the water separated from the oil phase after addition of the polar organic solvent being at least about 25:1.

13. A method for producing asphalt, comprising:

forming a froth from a mixture of a raw crude derived from mined oil sands and water, the raw crude having an asphaltene content, the froth corresponding to an oil-based phase on top of an aqueous phase;

adding a polar organic solvent to the froth under effective conditions so that an asphaltene content of the froth is at least 80% of the asphaltene content of the raw crude, the froth having an asphaltene content less than the asphaltene content of the raw crude, the polar organic solvent having a dipole moment of $2.0\times10^{-30}$ Cm to $5.9\times10^{-30}$ Cm at 20° C., a solubility in water of less than 25 g/L, a boiling point of at least 70° C., and a melting point of 20° C. or less, a weight ratio of solvent to bitumen after addition of the polar organic solvent being 1.4:1 to 2.2:1;

separating, after addition of the polar organic solvent, at least a portion of the froth having an asphaltene content that is at least 80% of the asphaltene content of the raw crude and less than the asphaltene content of the raw crude from the water to form a separated froth having an asphaltene content that is at least 80% of the asphaltene content of the raw crude and less than the asphaltene content of the raw crude;

preparing the separated froth for transport via pipeline;

distilling, after transport via pipeline, the separated froth to form an asphalt feed; and forming an asphalt from the asphalt feed.

14. The method of claim 13, wherein distilling the separated froth comprises performing a vacuum distillation on the separated froth, the asphalt feed corresponding to a bottoms fraction produced by the vacuum distillation.

15. The method of claim 13, wherein the separated froth is mixed with one or more other feeds prior to distillation.

16. The method of claim 13, wherein forming a froth from a mixture of raw crude and water comprises performing a hot water extraction process or a cold water extraction process on the raw crude.

17. The method of claim 13, wherein preparing the separated froth for transport via pipeline comprises separating the polar organic solvent from the separated froth.

18. The method of claim 17, wherein preparing the separated froth for transport further comprises mixing the separated froth with a naphtha boiling range or kerosene boiling range diluent.

19. The method of claim 1, wherein the solvent consists of a polar organic solvent.

20. The method of claim 13, further comprising adding a solvent comprising the polar organic solvent to the water separated from the oil phase, a weight ratio of solvent to bitumen in the water separated from the oil phase after addition of the polar organic solvent being at least about 25:1.

* * * * *